US009297253B2

(12) United States Patent
Hiorth et al.

(10) Patent No.: US 9,297,253 B2
(45) Date of Patent: Mar. 29, 2016

(54) INDUCTIVE CONNECTION

(75) Inventors: Espen Hiorth, Trondheim (NO); Bjørnar Svenning, Trondheim (NO)

(73) Assignee: Interwell Technology AS, Ranheim (NO)

( * ) Notice: Subject to any disclaimer, the term of this patent is extended or adjusted under 35 U.S.C. 154(b) by 215 days.

(21) Appl. No.: 14/130,757

(22) PCT Filed: Jun. 19, 2012

(86) PCT No.: PCT/EP2012/061641
§ 371 (c)(1),
(2), (4) Date: Feb. 13, 2014

(87) PCT Pub. No.: WO2013/004478
PCT Pub. Date: Jan. 10, 2013

(65) Prior Publication Data

US 2014/0152458 A1 Jun. 5, 2014

(30) Foreign Application Priority Data

Jul. 6, 2011 (NO) ..... 20110982

(51) Int. Cl.
*E21B 47/12* (2012.01)
*E21B 17/02* (2006.01)

(52) U.S. Cl.
CPC ..... *E21B 47/122* (2013.01); *E21B 17/028* (2013.01)

(58) Field of Classification Search
None
See application file for complete search history.

(56) References Cited

U.S. PATENT DOCUMENTS 6,540,032 B1 * 4/2003 Krueger ..... E21B 17/028 175/320
8,599,082 B2 * 12/2013 Mitchell ..... F01D 17/02 343/720
2002/0057210 A1 5/2002 Frey et al.
2004/0056663 A1 3/2004 Sinclair et al.
2004/0094303 A1 5/2004 Brockman et al.
2011/0042079 A1 2/2011 MacDougall et al.

FOREIGN PATENT DOCUMENTS

NO 324 328 B1 9/2007

OTHER PUBLICATIONS

International Search Report issued in PCT/EP2012/061641 mailed on Aug. 12, 2013 (2 pages).
Written Opinion of the International Searching Authority issued in PCT/EP2012/061641 mailed on Aug. 12, 2013 (5 pages).
Norwegian Search Report issued in Application No. 20110982 dated Feb. 6, 2012 (2 pages).

* cited by examiner

*Primary Examiner* — Brian Zimmerman
*Assistant Examiner* — Sara Samson
(74) *Attorney, Agent, or Firm* — Osha Liang LLP

(57) ABSTRACT

A well pipe for inductive connection to a well tool includes a tubular pipe string and an inductive pipe element. The pipe string includes an inner pipe wall defining a longitudinal opening, where a compartment is provided radially in a radial groove of the inner pipe wall and the inductive pipe element is provided in the compartment. The well tool includes a tool body and an inductive tool element provided in a groove provided radially on the outside of the tool body. The inductive tool element is connected to the tool body by a connection device, where the inductive tool element is movable between a run state and a set state, where the inductive tool element is provided in the groove in the run state and where the inductive tool element is radially protruding from the groove in the set state.

10 Claims, 9 Drawing Sheets

INDUCTIVE CONNECTION

CROSS-REFERENCE TO RELATED APPLICATIONS

This application is a National Stage application of International Patent Application No. PCT/EP2012/061641, filed on Jun. 19, 2012, which claims priority to Norwegian Patent Application No. 20110982, filed on Jul. 6, 2011. Both priority applications are hereby incorporated by reference in their entirety.

FIELD OF THE INVENTION

The present invention relates to a well tool for inductive connection to a well pipe and a well tool for inductive connection to a well tool. Moreover, the invention relates to a system for providing inductive connection between a well pipe and a well tool.

BACKGROUND

There are several known systems for communication between the topside of an oil and/or gas well and tools located further down in the oil and/or gas well. Moreover, it is known to supply such tools with electric energy from the topside.

US 2004094303 describes an inductively coupled method and apparatus for communication with wellbore equipment. Here it is shown a well pipe comprising inductive elements near or in the inner surface. The inductive elements of the well pipe are connected by means of a wire etc to the topside of the well.

A well tool comprising inductive elements in its outer surface may be lowered into the well pipe and positioned so that there is an inductive connection between the inductive elements of the tool and the inductive elements of the well pipe. Hence, signals can be transferred between the tool and the well pipe. However, both the inductive element of the well pipe and the inductive element of the well tool comprise a radial electrical winding. Consequently, the magnetic flux that is generated by a current flowing in the electrical windings of the inductive elements has a direction circumferentially around the well pipe.

The disadvantage of this technology is that since the inductive elements are provided in or near the inner surface of the well pipe, they are exposed to wear and damages due to friction and impacts from equipment lowered into and elevated out from the well. Moreover, the inductive coupling between the induction elements of the well pipe and the tool is rather poor, resulting in a low bandwidth.

NO 324328 describes another system for transferring power and signals between a well pipe and a tool lowered into the well. Here, the signal is induced into the well pipe by means of inductive elements provided radially around the well pipe.

US 2002057210 describes a method and system for subsurface logging utilizing a modified metallic tubular having an elongated body with tubular walls and a central bore adapted to receive a support member. The tubular including slotted stations to provide through-tubular signal transmission and/or reception. Pressure barrier means provide hydraulic isolation at the slotted stations. The support member is equipped with various sources and sensors, including an antenna adapted to generate a magnetic dipole moment with a transverse or controllable orientation, and adapted for engagement within the tubular.

US 20040056663 describes a method and apparatus for a downhole antenna comprising a housing having an outer surface and a longitudinally bored inner cavity, the outer surface having a first slot and a corresponding second slot extending from the outer surface to the longitudinally bored inner cavity; a first removable downhole antenna segment disposed in the first slot in a first transverse cross section of the housing, the first removable downhole antenna segment comprising at least one coil to inductively couple a signal from the longitudinally bored inner cavity to the earth formation.

The object of the present invention is to provide a well tool and a well pipe where the inductive elements are less vulnerable for wear and damages. Moreover, it is an object of the invention to provide a well tool and a well pipe where the electromagnetic communication between the inductive elements of the well tool and the well pipe is improved.

SUMMARY OF THE INVENTION

The present invention relates to a well pipe for inductive connection to a well tool, comprising:

- a tubular pipe string comprising an inner pipe wall defining a longitudinal opening, where a compartment is provided radially in the inner pipe wall;
- an inductive pipe element provided in the compartment, where the inductive pipe element is connected to an electric pipe circuit; where the compartment is provided in a radial groove of the inner pipe wall.

In one aspect, the inductive pipe element comprises a primary core body and a primary winding wound around the primary core body.

In one aspect, the primary winding is wound around the primary core body along a primary winding axis, where the primary winding axis is parallel to the central axis of the well pipe.

In one aspect, the primary core body comprises a top leg element, a primary leg element and a bottom leg element, where the primary winding is wound around the primary leg element.

In one aspect, the primary core body has a shape that resembles the capital letter I in a Serif font.

In one aspect, the inductive pipe element is separated from the longitudinal opening by means of a protective sheet made of a protective material.

In one aspect, the well pipe comprises a wire channel, where the inductive pipe element is connected to the electric pipe circuit by means of wires provided in the wire channel.

In one aspect, a plurality of inductive pipe elements are provided in the well pipe.

In one aspect, the plurality of inductive pipe elements are evenly distributed along circumferences of said well pipe.

The present invention also relates to a well tool for inductive connection to a well pipe, comprising:

- a tool body, where a groove is provided radially on the outside of the tool body;
- an inductive tool element provided in the groove of the tool body;

where the inductive tool element is connected to the tool body by means of a connection device, where the connection device is providing that the inductive tool element is movable between a run state and a set state, where the inductive tool element is provided in the groove in the run state and where the inductive tool element is radially protruding from the groove in the set state.

In one aspect, the connection device comprises:

a first pivotable arm having a first end pivotably connected to a first connection element of the tool and a second end pivotably connected to a first end of the inductive tool element; and a second pivotable arm having a first end pivotably connected to a second element of the tool and a second end pivotably connected to a second end of the inductive tool element.

In one aspect, the least one of the first connection element and the second connection element is movable in an axial direction in relation to the tool body.

In one aspect, the inductive tool element is connected to an electric tool circuit by means of a conductor provided within the first or second pivotable arm.

In one aspect, the inductive well element comprises a secondary core body and a secondary winding wound around the secondary core body.

In one aspect, the secondary winding is wound around the secondary core body along a secondary winding axis, where the secondary winding axis is parallel to the central axis of the well tool.

In one aspect, the secondary core body comprises a top leg element, a secondary leg element and a bottom leg element, where the secondary winding is wound around the secondary leg element.

In one aspect, the secondary core body has a shape that resembles the capital letter I in a Serif font.

In one aspect, the inductive tool element comprises an outer protective sheet made of a protective material.

The present invention also relates to a system for providing inductive connection between a well pipe as defined above and a well tool defined above, where the inductive tool element is protruding radially out from the groove of the well tool and into the groove of the well pipe in the set state; and where the inductive well element and the inductive tool element are longitudinally and rotationally aligned in a communication position in the set state.

DETAILED DESCRIPTION

Embodiments of the invention will now be described in detail with reference to the enclosed drawings, where:

FIG. 1*a* illustrates a longitudinal cross section of well tool in a run state inserted into a well pipe;

FIG. 1*b* is a cross sectional view along line A in FIG. 1*a;*

FIG. 1*c* is a cross sectional view along line B in FIG. 1*a;*

FIG. 2*a* illustrates a longitudinal cross section of the well tool in the run state positioned correctly with respect to a compartment in the well pipe;

FIG. 2*b* is an enlarged view of the circle in FIG. 2*a;*

FIG. 3*a* illustrates a longitudinal cross section of the well tool in the set state in the well pipe;

FIG. 3*b* is an enlarged view of the circle in FIG. 3*a;*

FIG. 3*c* is an cross sectional view of FIG. 3*a;*

Figure 1A:
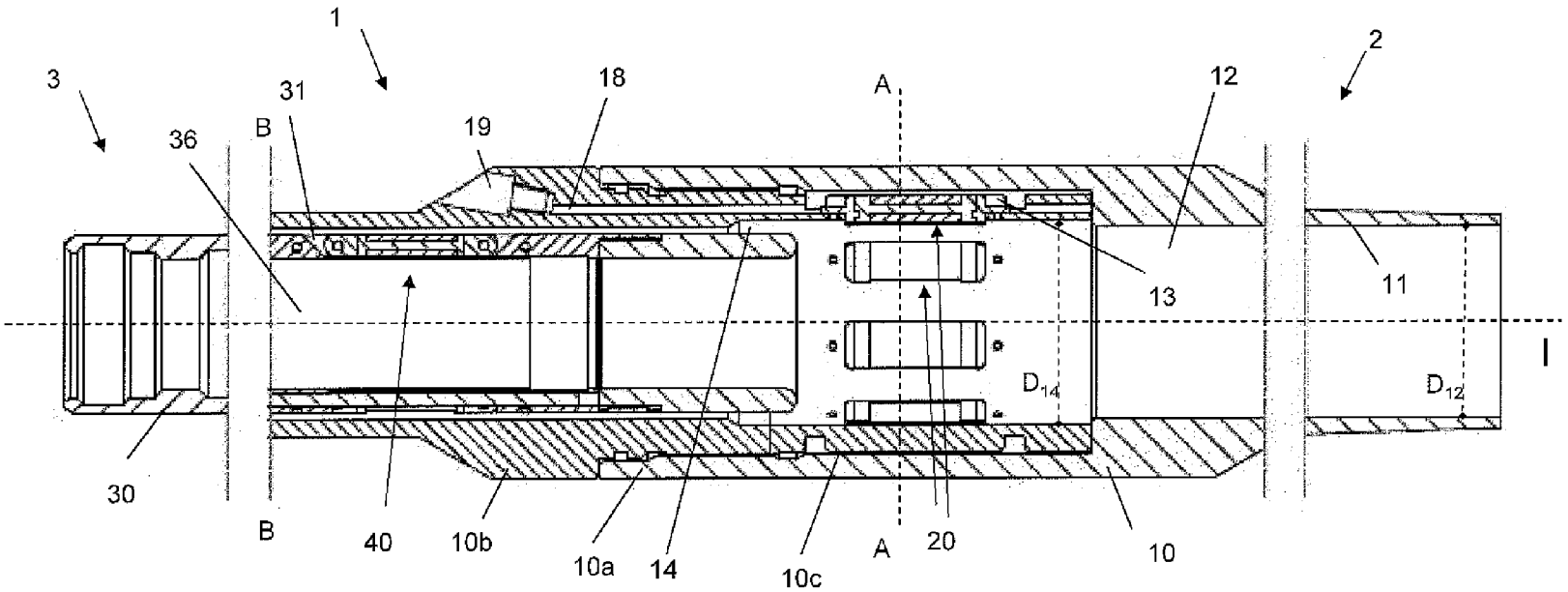

In the drawings, reference number 1 refers to a system for providing inductive connection between a well pipe 2 and a well tool 3. It should be noted that a setting and retrieval tool is used to set and retrieve the well tool 3 from the well pipe 2. The setting and retrieval tool is considered known for a person skilled in the art.

First, the well pipe 2 will be described with reference to FIG. 1*a-c*. The well pipe 2 comprises a tubular pipe string 10 comprising an inner pipe wall 11 defining a longitudinal opening 12. Through the opening 12 of the well pipe 2 oil and/or gas or other well fluids are normally flowing.

A compartment 13 is provided radially in the inner pipe wall 11, more specifically, the compartment 13 is provided in a radial groove 14 of the inner pipe wall 11. Hence, the groove 14 is forming a radial expansion of the longitudinal opening 12, i.e. the inner diameter $D_{14}$ of the groove 14 is larger than the inner diameter $D_{12}$ of longitudinal opening 12, as shown in FIG. 1*a*.

An inductive pipe element 20 is provided in the compartment 13. The compartment 13 adapted to receive the inductive pipe element 20. The compartment 13 may have an opening into the longitudinal opening so that that one side of the inductive pipe element is facing radially inwards. The compartment 13 may also be a closed compartment with respect the groove 14, i.e. there is no opening from the compartment 13 into the radial groove 14.

By providing the inductive pipe element 20 in the compartment 13 of the radial groove 14, the inductive pipe element 20 is less vulnerable for wear and damages.

As shown in FIG. 1*a*, the tubular pipe string 10 comprises a first body 10*a* and a second body 10*b* connected to each other along a connection interface 10*c*. The inductive element 20 is provided in the compartment 13 radially outside the second body 10*b*, and then the first body 10*a* is provided radially outside the second body 10 along the connection interface 10*c*.

The well pipe comprises a wire channel 18. In FIG. 1*a* it is shown that the wire channel 18 is provided from the compartment 13 and further through the second body 10*b* to an opening 19 on the outside of the well pipe. The inductive pipe element 20 is connected to an electric pipe circuit (not shown) by means of wires provided in the wire channel 18. The opening 19 forms a connection interface for a connector. The connector provides a fluid-tight connection between wires outside the well pipe and the inductive pipe element 20.

The electric pipe circuit may be located on the top side of the well, for example in the wellhead of a subsea well. The electric pipe circuit may send signals to and receive signals from the inductive pipe element 20, and it may also transfer electric power to the inductive pipe element 20. The electric pipe circuit may also comprise communication means which provides communication with a control central on a vessel or onshore, for transferring real-time signals from the inductive pipe element 20 to the control central. The inductive pipe element 20 will now be described with reference to FIGS. 2*b* and 3*b*.

Figure 2A:
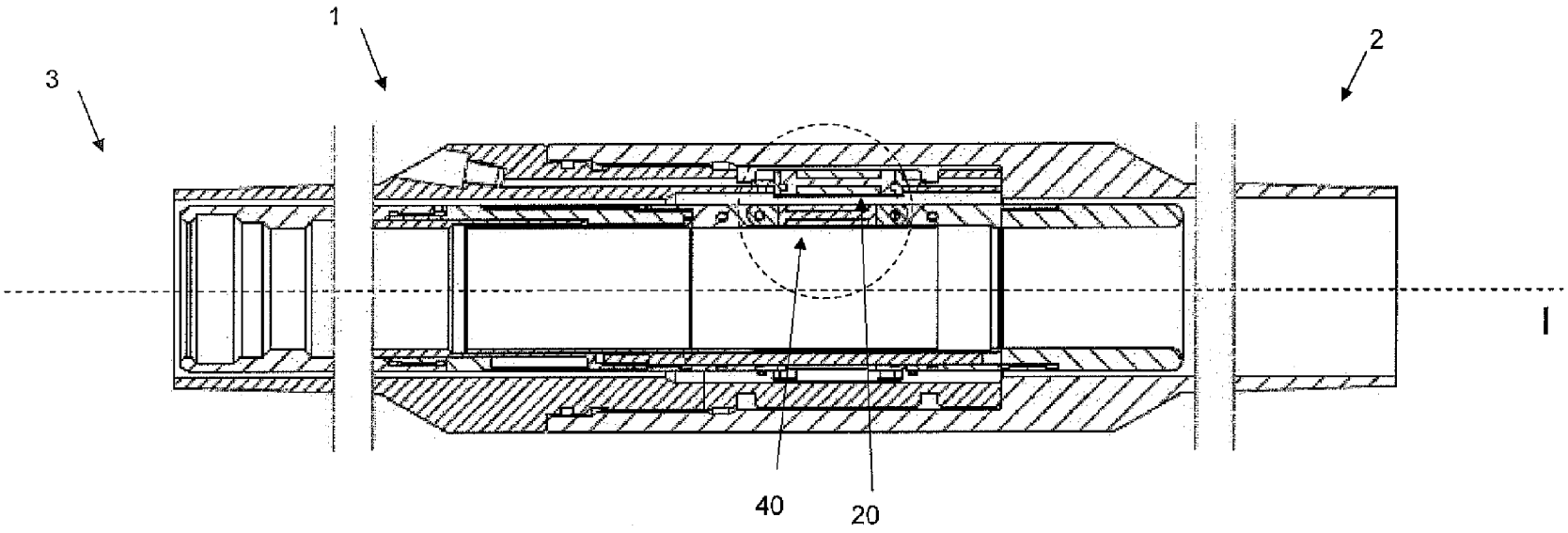
Figure 2B:
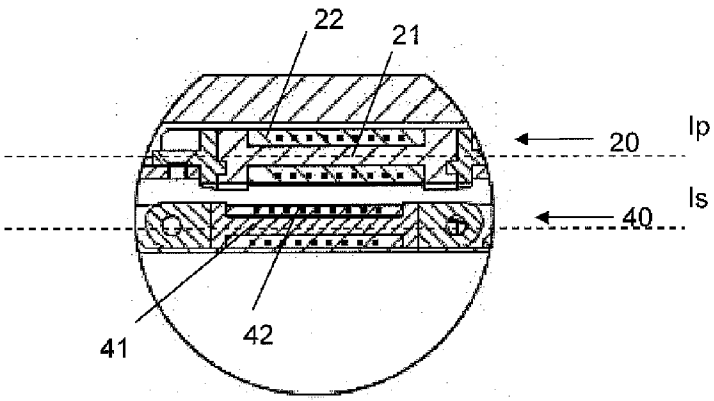
Figure 3A:
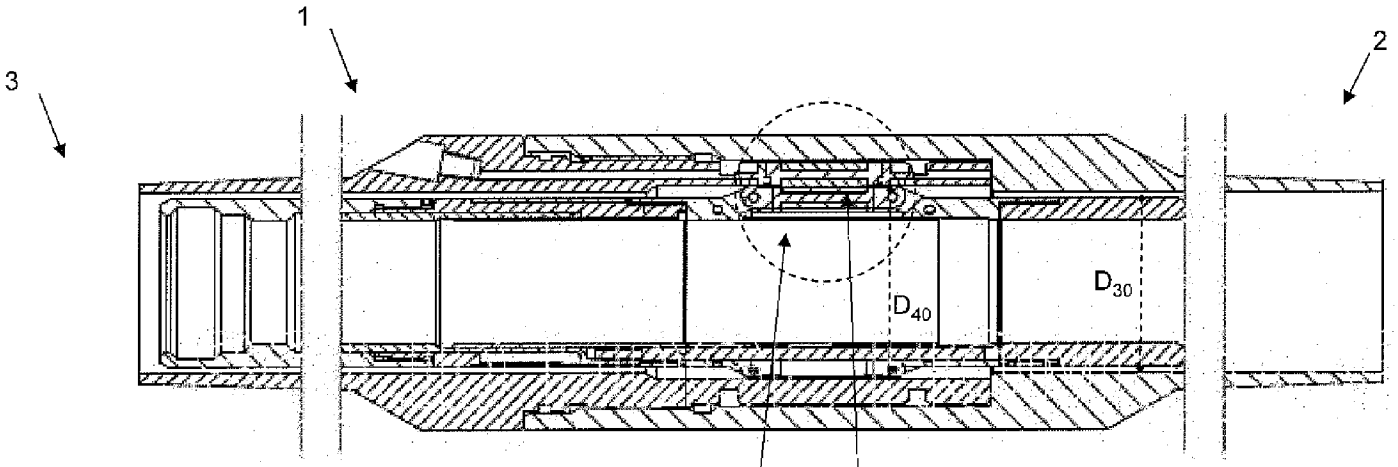
Figure 3C:
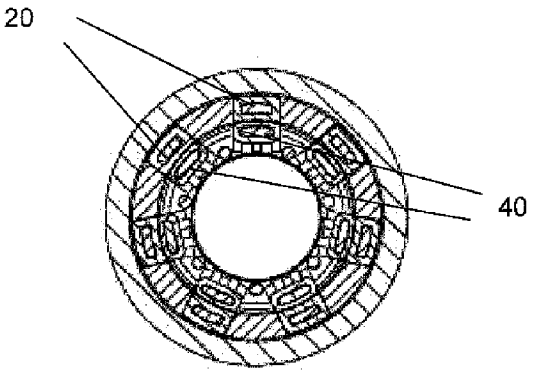
Figure 3B:
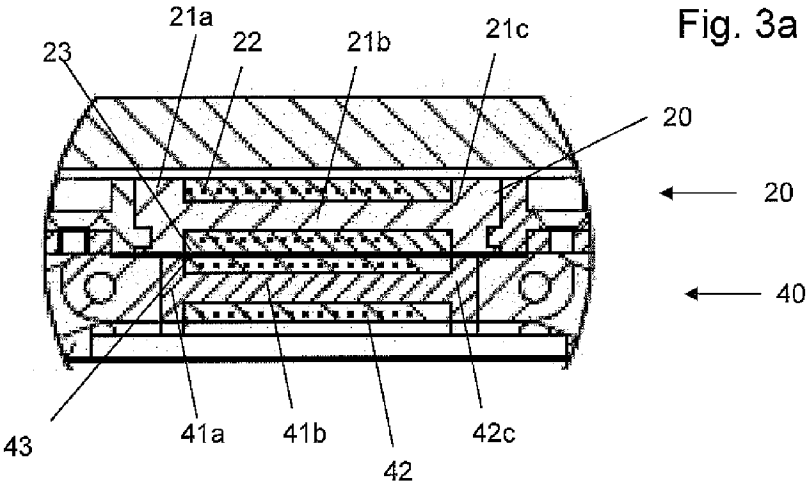

The inductive pipe element 20 comprises a primary core body 21 and a primary winding 22 wound around the primary core body 21. In FIG. 2*b* it is shown that the primary winding 22 is wound around the primary core body 21 along a primary winding axis Ip. The primary winding axis Ip is parallel to the central axis I of the well pipe. The primary core body 21 comprises a top leg element 21*a*, a primary leg element 21*b* and a bottom leg element 21*c*, where the primary winding 22 is wound around the primary leg element 21*b*. In FIG. 3*b* it can be seen that the primary core body 21 in cross section has a shape that resembles the capital letter I in a Serif font.

The primary core body 21 is made of a transformer core material, such as sheet metal.

The inductive pipe element 20 may be separated from the longitudinal opening 12 by means of a protective sheet 23 made of a protective material. The protective sheet 23 may be a wall separating the compartment 13 from the longitudinal opening 12 as described above. Alternatively, the protective sheet 23 may comprise a protective sleeve around the inductive pipe element. Alternatively, the protective sheet 23 may comprise a thin metal layer provided around the inductive pipe element 20. Alternatively, the protective sheet 23 may comprise a protective coating, such as paint.

Figure 1B:
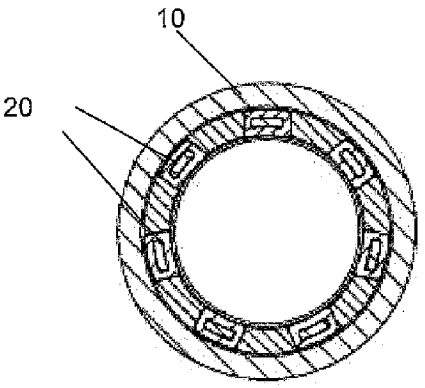
Figure 1C:
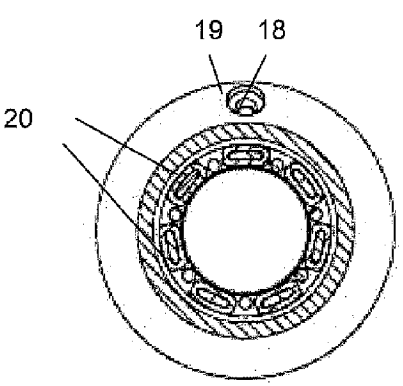

In FIGS. 1*b* and 1*c* it is shown that a plurality of inductive pipe elements 20 are provided in the well pipe, here the well pipe 2 comprises seven inductive elements.

The plurality of inductive pipe elements 20 are evenly distributed along circumferences of said well pipe.

Figures 4, 5:
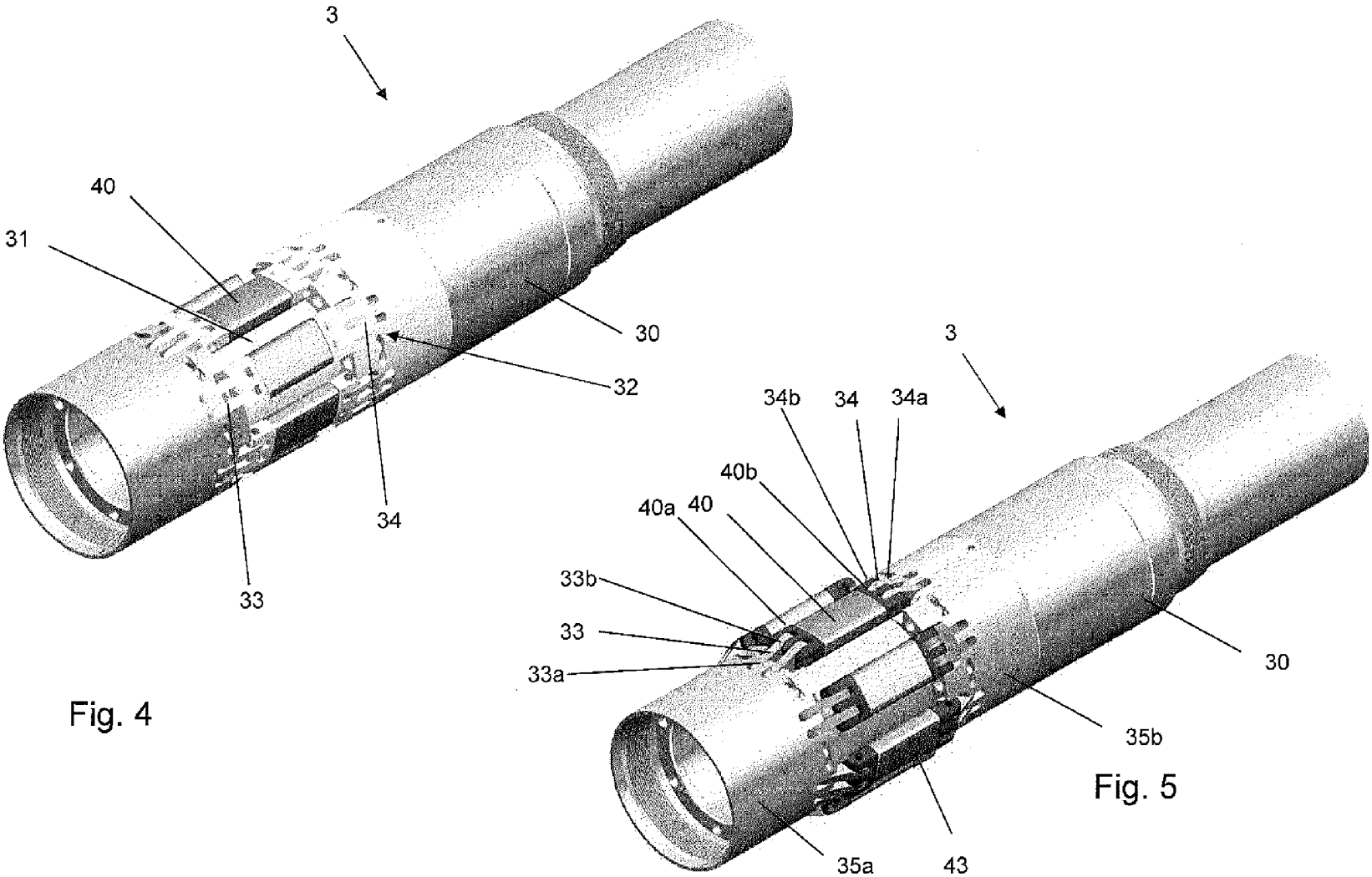
FIG. 4 illustrates a perspective view of the well tool in the run state.
FIG. 5 illustrates a perspective view of the well tool in the set state.

The well tool 3 for inductive connection to the well pipe 2 will now be described. The well tool 3 comprises a tool body 30, as shown in FIG. 1*a*, FIG. 4 and FIG. 5. The tool body 30 has an outer maximum diameter $D_{30}$ which is less than the inner diameter $D_{12}$ of the longitudinal opening 12, for the well tool 3 to be able to pass through the well pipe 2.

A groove 31 is provided radially on the outside of the tool body 30, i.e. the groove 31 is provided circumferentially around the outer surface of the tool body 30. An inductive tool element 40 is provided in the groove 31 of the tool body 30. The inductive tool element 40 is connected to the tool body 30 by means of a connection device 32.

The connection device 32 is providing that the inductive tool element 40 is movable between a run state and a set state, where the inductive tool element 40 is provided in the groove 31 in the run state and where the inductive tool element 40 is radially protruding from the groove 31 in the set state.

Hence, in the run state the inductive tool element 40 is protected in the groove 31. In FIG. 1*a* the well tool 3 is run into the longitudinal opening 12 of the well pipe 2. In FIG. 2*a*, the well tool 3 is positioned in relation to the inductive elements 20 of the well pipe 2. In FIG. 3*a*, the inductive tool element 40 is moved to its set state, and is radially protruding from the groove 31. In FIG. 3*a* it is shown that the radially protruding inductive tool elements 40 provides that the outer diameter $D_{40}$ of the well tool 3 in the set state is larger than the maximum diameter $D_{30}$ of the well tool in its run state. Hence, it is possible to avoid a large gap between the inductive pipe element 20 and the inductive tool element 40 when inductively connected to each other, while the inductive pipe element 20 and the inductive tool element 40 are less vulnerable for wear and damages during the setting and retrieval.

It is now referred to FIG. 5. The connection device 32 comprises a first pivotable arm 33 having a first end 33*a* pivotably connected to a first connection element 35*a* of the tool 3 and a second end 33*b* pivotably connected to a first end 40*a* of the inductive tool element 40. Moreover, the connection device 32 comprises a second pivotable arm 34 having a first end 34*a* pivotably connected to a second element 35*b* of the tool 3 and a second end 34*b* pivotably connected to a second end 40*b* of the inductive tool element 40. At least one of the first connection element 35*a* and the second connection element 35*b* is movable in an axial direction in relation to the tool body 30 in order to move the inductive tool element between its set and run position.

It is now referred to FIGS. 2*b* and 3*b*. The inductive tool element 40 is provided in a similar way as the inductive pipe elements 20. Hence, the inductive well element 40 comprises a secondary core body 41 and a secondary winding 42 wound around the secondary core body 41. The secondary winding 42 is wound around the secondary core body 41 along a secondary winding axis Is, where the secondary winding axis Is is parallel to the central axis I of the well tool 3, and consequently also parallel to the primary winding axis Ip.

The secondary core body 21 comprises a top leg element 41*a*, a secondary leg element 41*b* and a bottom leg element 41*c*, where the secondary winding 42 is wound around the secondary leg element 41*b*. The secondary core body 41 has a shape that resembles the capital letter I in a Serif font. As described above, the inductive tool element 40 may comprise an outer protective sheet 43 made of a protective material, as described above for the inductive pipe element 20.

The secondary core body 41 is made of a transformer core material, such as sheet metal.

The well tool 3 may comprise a plurality of inductive tool elements 40. In FIG. 3*c* it is shown that the well tool 3 has the same number of inductive tool elements 40 as the number of inductive pipe elements of the well pipe, i.e. seven.

The inductive tool element 40 is connected to an electric tool circuit (not shown) by means of a conductor provided within the first or second pivotable arm 33, 34. The electric tool circuit may for example be a temperature sensor, a pressure sensor, an electric sliding sleeve, an insert down hole safety valve, an electrically adjustable choke, a seismic instruments, a flow meter, a multiphase flow meter, a battery accumulator etc.

Hence, the system 1 comprising the well pipe 2 and the well tool 3 is providing an inductive connection where electric signals and/or electric power can be transferred between the electric tool circuit and the electric pipe circuit.

In the system 1, the inductive tool element 40 is protruding radially out from the groove 31 of the well tool 3 and into the groove 14 of the well pipe 2 in the set state, and the inductive well element 20 and the inductive tool element 40 are longitudinally and rotationally aligned in a communication position in the set state as shown in FIG. 3*c*. In this communication position, the distance between each inductive tool element 40 and each inductive pipe element 20 may be very small and even zero, and an effective inductive communication may be achieved. It should be noted that the elements 20, 40 may be designated for special purposes, for example that one or two pairs of elements 20, 40 is used to transfer electric power from the well pipe 2 to the well tool 3, while another one or two pairs of elements 20, 40 is used to transfer electric signals from the well tool 3 to the well pipe 2.

This may require that only one specific orientation of the well tool 3 with respect to the well pipe 2 is possible.

It should be noted that the well tool 3 may comprise anchoring devices (not shown) for anchoring the well tool 3 to the inner surface 11 of the well pipe. This is considered known for a skilled person.

It should also be noted that the well tool 3 may comprise a longitudinal central opening 36 allowing fluid to pass through the well tool 3. Hence, normal operation of the well is allowed when the well tool 3 is set in the well pipe. The electric tool circuit of the well tool 3 is now continuously connected to the electric pipe circuit of the wellhead, or is even continuously connected to the control central on a vessel or onshore. Hence, data can be transferred in real time from the electric tool circuit of the well tool, and the operating time of the electric tool circuit is very long since electric power can be transferred continuously from the electric pipe circuit to the electric tool circuit.

Figure 6:
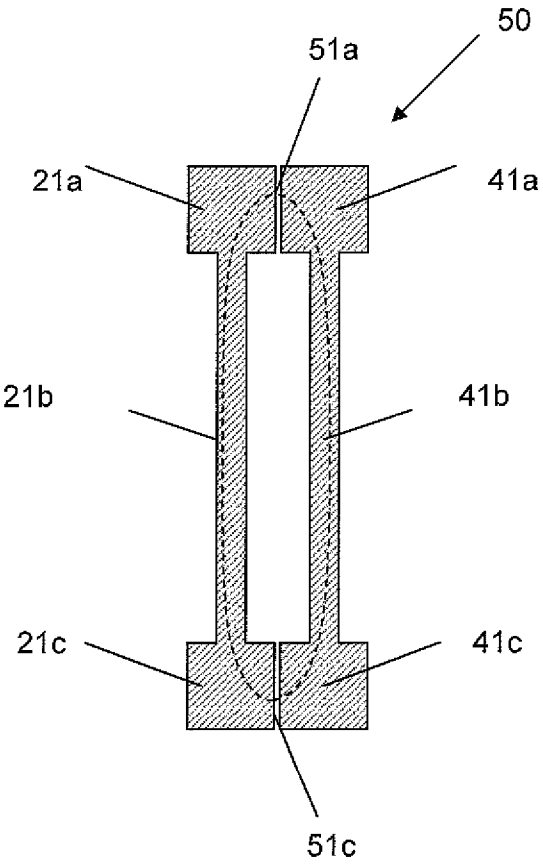
FIG. 6 illustrates the transformer core formed by primary core body and the secondary core body.

It is now referred to FIG. 6. When the inductive tool element 40 is longitudinally and rotationally aligned in the communication position with respect to the inductive pipe element 20 as shown in FIG. 3*c*, the primary core body 21 and the secondary core body 41 together form a transformer core 50. The top leg elements 21*a*, 41*a* of the primary and secondary core bodies 21, 41 form a top transverse leg of the transformer core 50. The bottom leg elements 21*c*, 41*c* of the primary and secondary core bodies 21, 41 form a bottom transverse leg of the transformer core 50. The radial distance between the well pipe 2 and the well tool 3, which due to the radial protruding inductive tool element 40 is very small, provides a first magnetic gap 51*a* in the top transverse leg and a second magnetic gap 51*c* in the bottom transverse leg of the transformer core 50 which are very small. The dashed line indicates the main magnetic flux through the transformer core 50. Since the main flux here is provided almost entirely through transformer core material, an effective magnetic connection is provided between the elements 20, 40.

Figure 7:
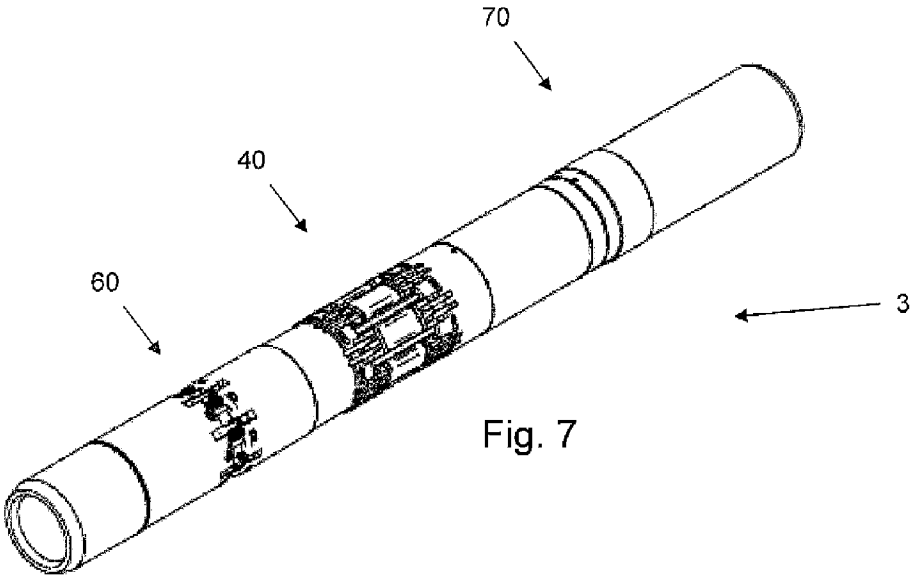
FIG. 7 illustrates a perspective view of a second embodiment of the well tool in the run state.
Figure 8:
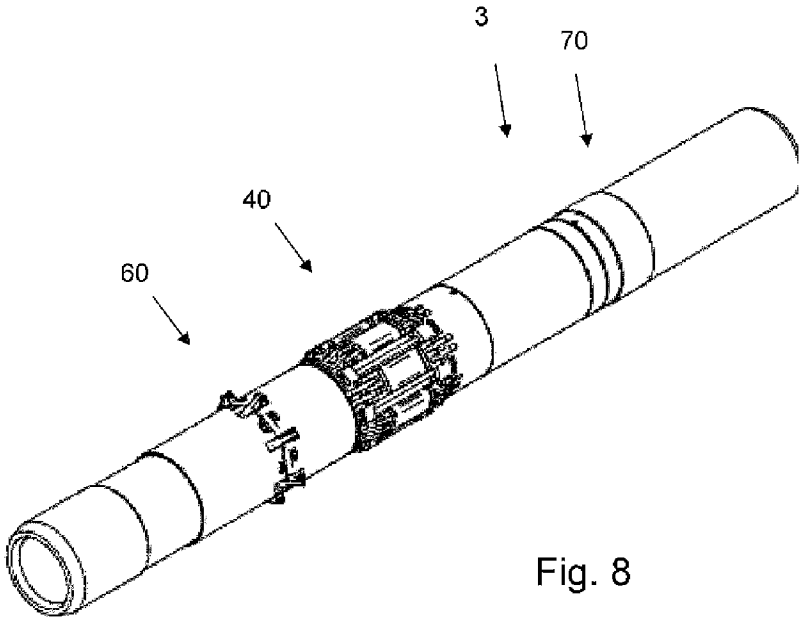
FIG. 8 illustrates a perspective view of the second embodiment of the well tool in the set state.

It is now referred to FIGS. 7 and 8, where a second embodiment of the well tool 3 is illustrated. The second embodiment of the well tool 3 comprises the same elements as the first embodiment described above, and the description of these elements will not be repeated here.

Here, the well tool 3 comprises a tool centering element 60. The tool centering element 60 is provided in a groove 61 provided circumferentially on the outside of the tool body 30. The tool centering element 60 comprises a first connection arm 62 and a second arm 63 with their respective first ends pivotably connected to each other. The first end of the second connection arm 63 is pivotably connected an lower centering body 64. The first end of the first connection arm 62 is pivotably connected to a upper centering body 65, where the upper centering body 65 is connected to a lower end 66 of the tool body 30 by means of a spring 67.

The tool centering element 60 is movable between a set state and a run state, where the tool centering element 60 is provided in the groove 31 in the run state and is radially protruding from the groove 61 in the set state. The tool centering element 60 is located below the inductive tool element 40.

The lower centering body 64 is connected to a control mandrel 68 by means of a rod 69. The control mandrel 68 may be connected to the setting and retrieval tool.

Figure 9:
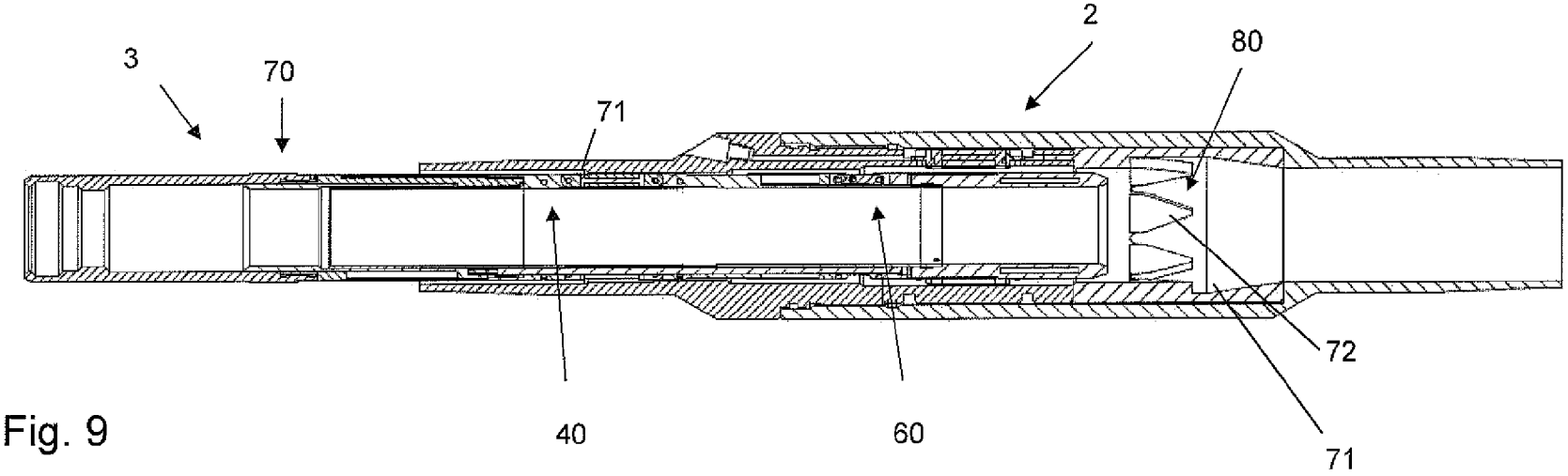
FIG. 9 illustrates a longitudinal cross section of the second embodiment of the well tool in a run state inserted into a second embodiment of the well pipe.

Moreover, the well tool 3 comprises a shoulder 70 radially protruding from the tool body 30. The shoulder 70 provides the well tool 3 a larger diameter in a circumferential area, as shown in FIGS. 7 and 9. The shoulder 70 is located above the inductive tool element 40.

Figure 10:
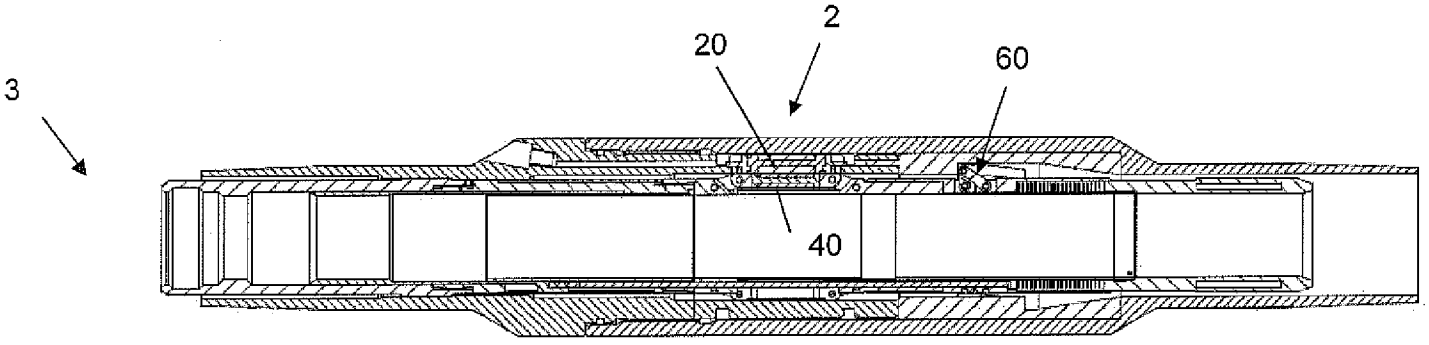
FIG. 10 illustrates a longitudinal cross section of the second embodiment of the well tool in the set state positioned correctly with respect to the well pipe.
Figure 11:
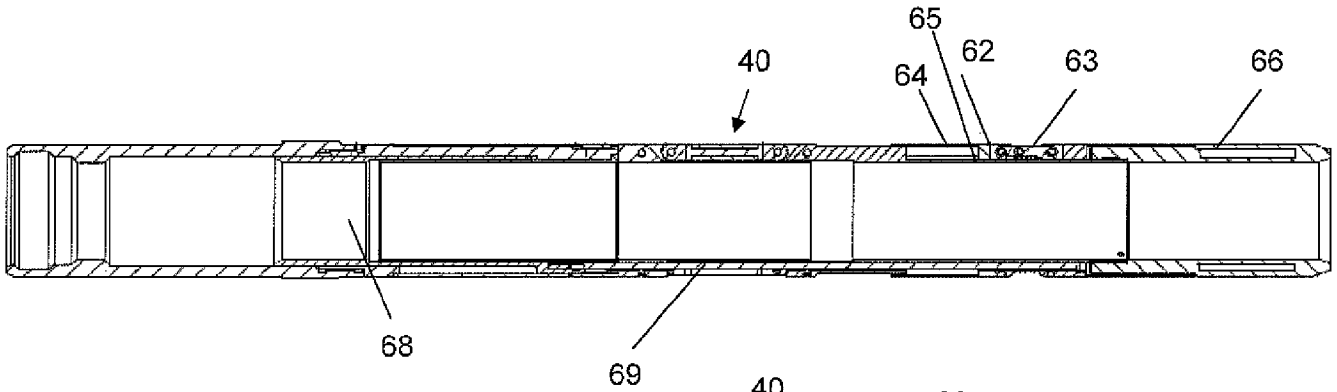
FIG. 11-13 illustrates the second embodiment of the well tool from the run state to the set state.
Figure 12:
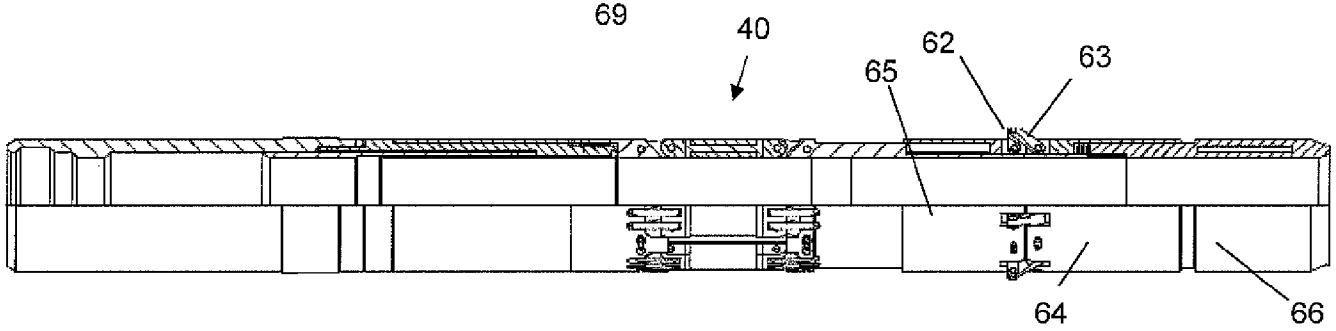
Figure 13:
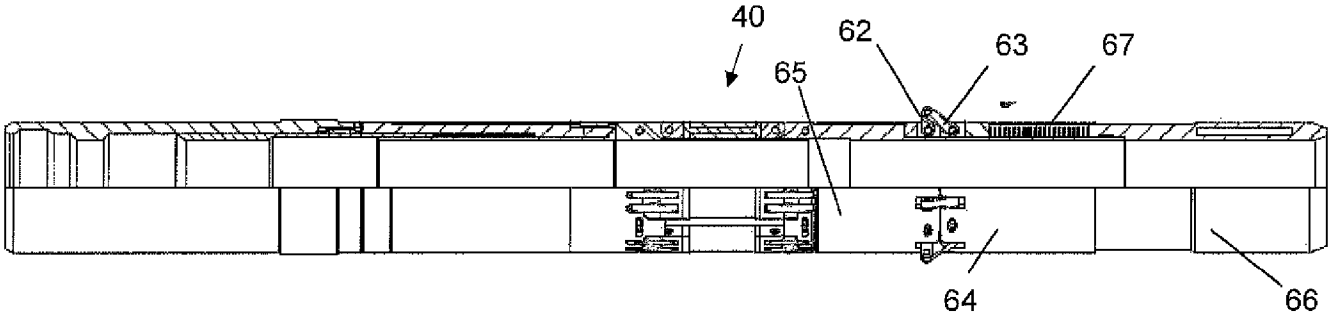
Figure 14:
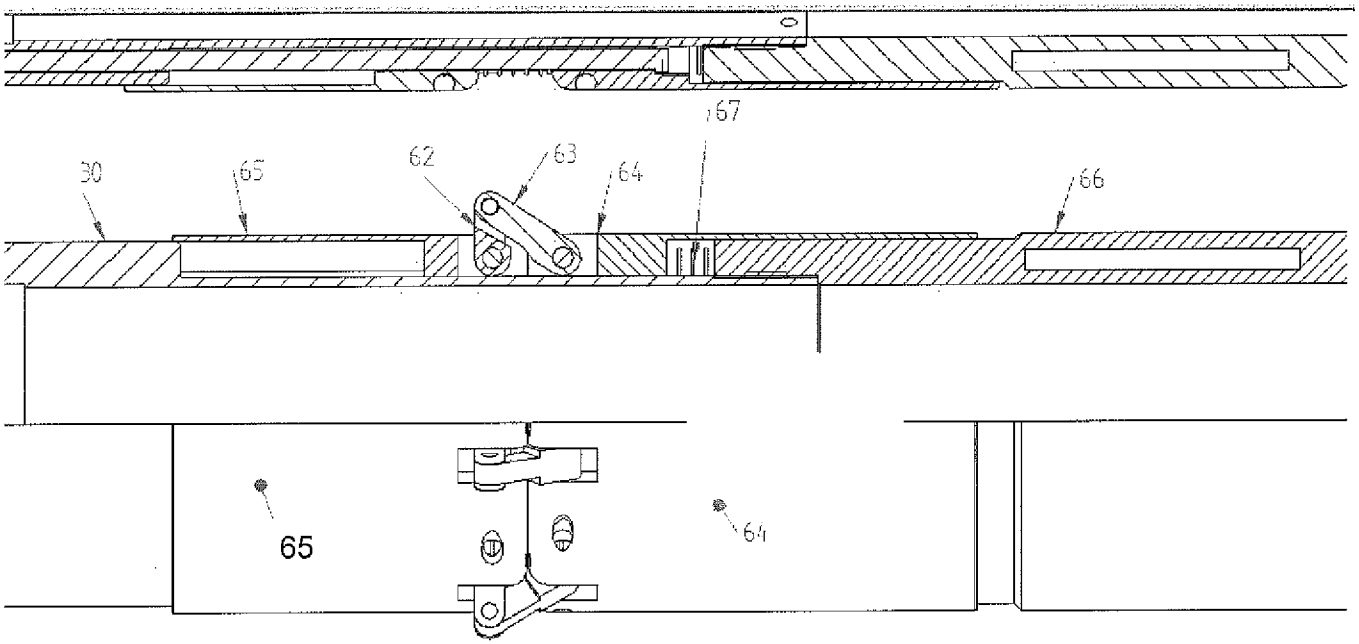
FIG. 14 is an enlarged view of the tool centering element of FIG. 12.

In FIGS. 9 and 10, the second embodiment of the well tool is provided in its run state inside a second embodiment of the well pipe 2.

The second embodiment of the well pipe 2 comprises the same elements as the first embodiment described above, and the description of these elements will not be repeated here.

The second embodiment of the well pipe 2 comprises a stop 71, adapted to receive the shoulder 70.

The well pipe 3 comprises a tool centering track 80. The tool centering track 80 is provided in an radially extended area 81 of the longitudinal opening 12 of the pipe, and comprises substantially V-shaped guides 82 protruding radially inwards from the extended area 81, as shown in FIG. 9. The tool centering track 80 is adapted to receive the tool centering element 80.

The operation of the second embodiment of the well pipe 2 and the well tool 3 will now be described. In a first step, the well tool 3 is in its run state and is inserted down into the longitudinal opening 12 of the well pipe, to the position showed in FIG. 9, by means of the setting and retrieval tool. The well tool 3 is then moved further down into the well (to the right in FIG. 9) until the shoulder 70 abuts the stop 71. The tool centering element 60 is now located in the extended area 81.

Then, the tool centering element 60 is brought from its run position to its set position by means of the setting and retrieval tool pulling the rod 69 upwardly (i.e. to the left in FIG. 10). The tool centering element 60 is now radially protruding from the well tool 3 in the extended area 81 of the well pipe. The tool centering element 60 is then pulled further upwards (i.e. to the left in FIG. 10). The tool centering element 60 will now be guided by the tool centering track 80, which provides a rotation of the tool centering elements 60 and hence rotation of the inductive tool elements 40 until they are rotationally aligned with respect to the inductive pipe elements. The inductive tool elements 40 are then brought to their set position towards the inductive well elements 20, as described above with respect to the first embodiment.

Consequently, the tool centering element 60 and the tool centering track 80 provides correct rotational alignment of the inductive elements 20, 40. Moreover, the shoulder 70 and the stop 71 provide a correct longitudinal alignment of the inductive elements 20, 40.

In the second embodiment, there are the same numbers of tool centering elements 60 and tool centering track 80 as inductive tool elements 40. However, other alternatives are possible.

The invention claimed is:

1. Well tool for inductive connection to a well pipe, comprising:

a tool body, where a groove is provided radially on the outside of the tool body; and an inductive tool element provided in the groove of the tool body;

wherein the inductive tool element is connected to the tool body by a connection device, where the connection device allows the inductive tool element to be movable between a run state and a set state, where the inductive tool element is provided in the groove in the run state and where the inductive tool element is radially protruding from the groove in the set state.

2. The well tool according to claim 1, where the connection device comprises:

a first pivotable arm having a first end pivotably connected to a first connection element of the tool and a second end pivotably connected to a first end of the inductive tool element; and a second pivotable arm having a first end pivotably connected to a second element of the tool and a second end pivotably connected to a second end of the inductive tool element.

3. The well tool according to claim 2, where at least one of the first connection element and the second connection element is movable in an axial direction in relation to the tool body.

4. The well tool according to claim 1, where the inductive tool element is connected to an electric tool circuit by means of a conductor provided within the first or second pivotable arm.

5. The well tool according to claim 1, where the inductive well element comprises a secondary core body and a secondary winding wound around the secondary core body.

6. The well tool according to claim 5, where the secondary winding is wound around the secondary core body along a secondary winding axis, where the secondary winding axis is parallel to a central axis of the well tool.

7. The well tool according to claim 5, where the secondary core body comprises a top leg element, a secondary leg element and a bottom leg element, where the secondary winding is wound around the secondary leg element.

8. The well tool according to claim 5, where the secondary core body has a shape that resembles the capital letter I in a Serif font.

9. The well tool according to claim 5, where the inductive tool element comprises an outer protective sheet made of a protective material.

10. A system for providing inductive connection comprising:

a well pipe comprising:

a tubular pipe string having an inner pipe wall defining a longitudinal opening, where a compartment is provided radially in a radial groove in the inner pipe wall, and an inductive pipe element provided in the compartment, where the inductive pipe element is connected to an electric pipe circuit; and a well tool comprising:

a tool body, where a groove is provided radially on the outside of the tool body, and an inductive tool element provided in the groove of the tool body, wherein the inductive tool element is connected to the tool body by a connection device, where the connection device allows the inductive tool element to move between a run state and a set state, where the inductive tool element is provided in the groove in the run state, wherein the inductive tool element is protruding radially out from the groove of the well tool and into the groove of the well pipe in the set state; and wherein the inductive pipe element and the inductive tool element are longitudinally and rotationally aligned in a communication position in the set state.

* * * * *